United States Patent [19]

Warden

[11] Patent Number: 4,940,070

[45] Date of Patent: Jul. 10, 1990

[54] BIFOLD PRIVACY MINIBLIND

[76] Inventor: Scott L. Warden, 1742 S. Louisville, Tulsa, Okla. 74112

[21] Appl. No.: 321,726

[22] Filed: Mar. 10, 1989

Related U.S. Application Data

[63] Continuation-in-part of Ser. No. 174,984, Mar. 29, 1988, abandoned.

[51] Int. Cl.[5] ..... E06B 9/26

[52] U.S. Cl. ..... 160/176.1; 160/115

[58] Field of Search ..... 160/176.1, 115, 178.1, 160/168.1

[56] References Cited

U.S. PATENT DOCUMENTS

| | | | |
|---|---|---|---|
| 2,115,663 | 4/1938 | Balthasar | 156/17 |
| 2,162,226 | 6/1939 | McKinney | 156/17 |
| 2,214,539 | 9/1940 | Reinike | 156/17 |
| 2,296,010 | 9/1942 | Balthasar | 156/17 |
| 2,459,517 | 1/1949 | Gearhart | 160/115 |
| 2,506,507 | 5/1950 | Kiatta | 160/115 |
| 2,579,485 | 12/1951 | Ferguson et al. | 160/115 |
| 2,719,586 | 10/1955 | Graham | 160/115 |
| 2,836,237 | 5/1958 | Hogin et al. | 160/115 |
| 2,928,461 | 3/1960 | Barrett | 160/115 |
| 3,727,665 | 4/1973 | Debs | 160/178.2 |
| 4,621,672 | 11/1986 | Hsu | 160/115 |
| 4,799,524 | 1/1989 | Guermonprez | 160/168.1 X |

*Primary Examiner*—Blair M. Johnson

*Attorney, Agent, or Firm*—Head & Johnson

[57] ABSTRACT

A miniblind Venetian blind. The individual blinds are supported by a string ladder support system on each side. Each string ladder support system has a front vertical ladder string and a back vertical ladder string with short support strings fastened between them like a ladder which supports the individual slats. A main pull string at each ladder support system extends down through holes in each blind to a bottom rail where it is attached. The main pull string goes through the top housing and down over a roller so that the blind can be raised and lowered. A new privacy drawstring is strung along the main pull strings and is connected to the back ladder string at a selected level. By pulling on the privacy drawstrings the blinds below the point at which these privacy drawstrings are attached to the ladder can be tilted independently of the tilt of the blinds above that point. In one embodiment the ends of the privacy drawstring are attached such that by pulling on the privacy drawstring the main drawstring is also pulled.

4 Claims, 7 Drawing Sheets

BIFOLD PRIVACY MINIBLIND

CROSS REFERENCE TO RELATED APPLICATIONS

This application is a continuation-in-part of my pending application Ser. No. 07/174,984, filed 3/29/88 and entitled BIFOLD PRIVACY MINIBLIND now abandoned.

BACKGROUND OF THE INVENTION

This invention relates to window Venetian blinds and in particular to one whereby one section of the blinds can be opened or closed independent of the position of the other.

In the operations of most commercially available Venetian blinds the plurality of slats are operated as a unit. That is, if one section of the blind is opened, all slats are in the open position. IF one section is closed they are all closed. There have been numerous suggestions on how to modify the conventional Venetian blinds so that one section of the blind, that is an upper portion can be open while the lower portion can be closed. Some such systems are shown in U.S. Pat. No. 4,621,672 to Hsu and to U.S. Pat. No. 2,579,485 to H. W. Ferguson et al. These all require considerable modification to the existing mechanisms and apparently are not too practical inasmuch as none of these methods are commonly available on the market.

It is therefore an object of the present invention to provide an improved modification to Venetian blinds whereby a lower section can be opened while an open section is closed or vice versa.

It is a further object of this invention to provide a system which is simple and extremely inexpensive to add to commercially available Venetian blinds.

SUMMARY OF THE INVENTION

This invention concerns a simple addition to commercially available Venetian blinds such as the popular miniblinds whereby a bottom section can be opened or closed independent of the opening or closing of an upper section. The many slats of a miniblind are typically supported from at least two string ladder support system which have two strings spaced apart. Each ladder holds a front string and a back string with lateral slat support strings tied between the two at selected distances to support the individual slats. A drawstring extends down through holes in each individual blind adjacent the ladder support system strings and extends down to a bottom rail. On these commercially available blinds a stick or stem is provided to turn a main shaft which will change its tilt or inclination of the slats to either open or close the blinds.

In accordance with my invention, for each string ladder support system, I provide a privacy drawstring which follows the path alongside of the main pull string into the upper housing. Each of these new privacy drawstrings extend downwardly through an exit opening (preferably a hole through which the back string extends) to a selected point where each is clipped to its adjacent back string. By pulling on the privacy drawstring that portion of the blind assembly below the point at which the privacy drawstrings are attached can be opened or closed independently of the section of blinds above that point. By simple manipulation of the privacy drawstring and the stem either the top or bottom section can be opened or closed independent of the other section.

In a preferred embodiment the privacy drawstring is attached to a top pull such as a cylindrical plug. The main drawstring passing freely through the top pull but is attached to a lower pull or plug which fits into or against the upper pull. The drawstring can be pulled independently of the privacy string but the privacy string is prevented from being over-pulled due to the upper pull contacting the lower pull.

DETAILED DESCRIPTION

Figure 1:
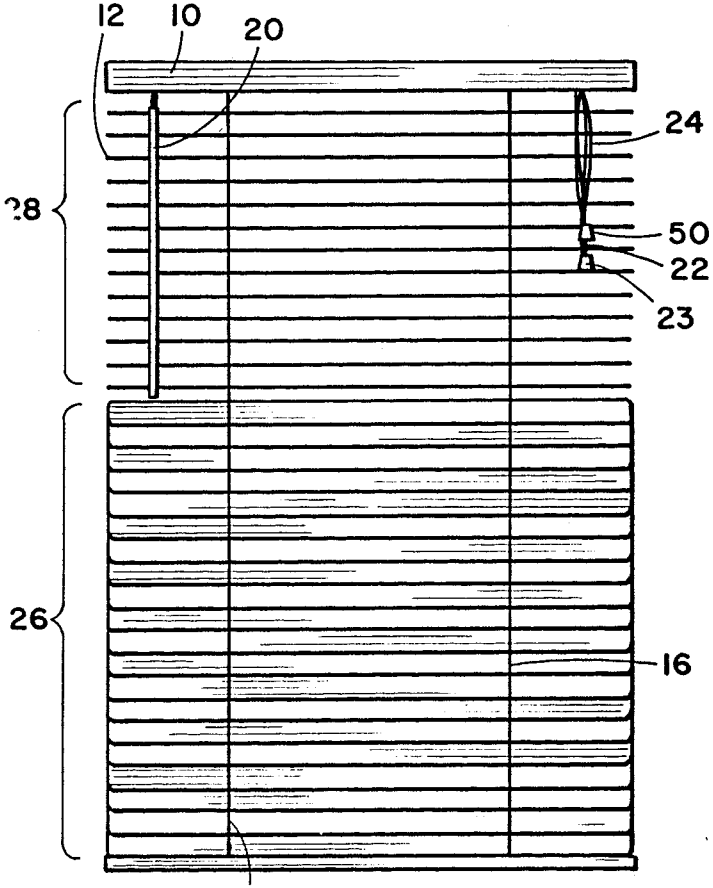
FIG. 1 is a front elevation view of a venetian blind modified in accordance with my invention and in which a bottom portion is closed for privacy and a top portion is open for ventilation and light.

Attention is first directed to FIG. 1 which shows a front view, that is looking at it from inside a house or building, of a window blind such as is commonly called a miniblind, which has been modified with my invention. This includes a long top support 10 from which is suspended a shade having a plurality of horizontal slats 12 which are supported by a ladder support system 14 and 16. Each ladder support system typically includes a front ladder string, a back ladder string and lateral slat support strings extending between the back and front ladder strings. A bottom rail or weight bar 18 is provided at the lower end to hold the blind in position. A stem 20 is provided to adjust the tilt or inclination of the slats 12. A drawstring unit 22, along each ladder support system, extends over mechanisms as in top support 10 down to weight bar 18 so that the slats 12 can be pulled from the bottom upwardly in a known manner. The ends of the drawstrings are held by button 23.

I have added a privacy drawstring 24 to the present commercially available miniblinds. By proper pulling on or releasing of privacy drawstring 24 and manipulation of stem 20 I can cause the Venetian blinds to take the position shown in FIG. 1 in which the lower portion 26 is in a closed position and the top portion 28 is open. By proper manipulation of privacy drawstring 24 and manipulation of stem 20, as will be discussed further, I can reverse the position of the privacy to that shown in FIG. 2 in which the lower portion 26 is open to permit air or light to come through and the upper portion 28 is in a closed position.

Miniblinds, upon which I can apply my improvement, are commercially available. The blind includes the top support 10, the weight bar 18, slats 12 supported by ladder support systems 16, slat inclination adjusting bar or stem 20 and individual drawstrings of drawstring unit 22.

Figure 4:
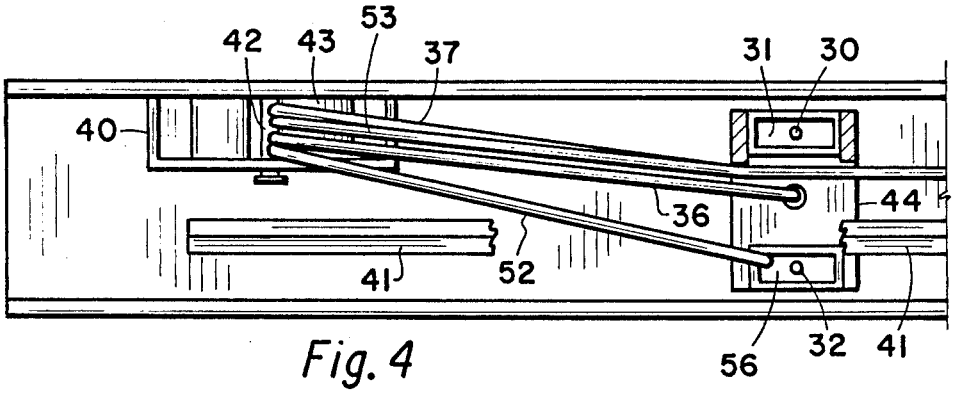
FIG. 4 is a plan view showing a top view of the view of FIG. 3.
Figure 3:
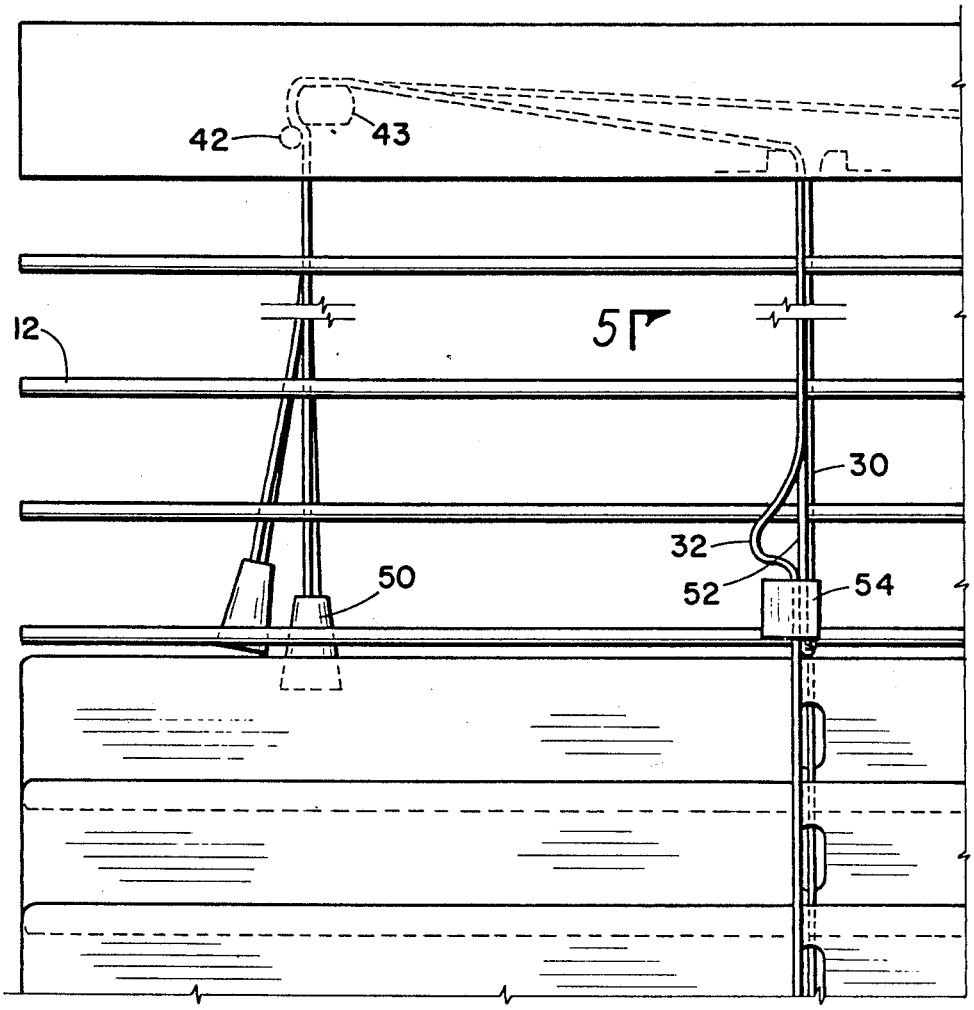
FIG. 3 is a rear view of a portion of the blind of FIG. 1 showing an upper right hand corner section.
Figure 5:
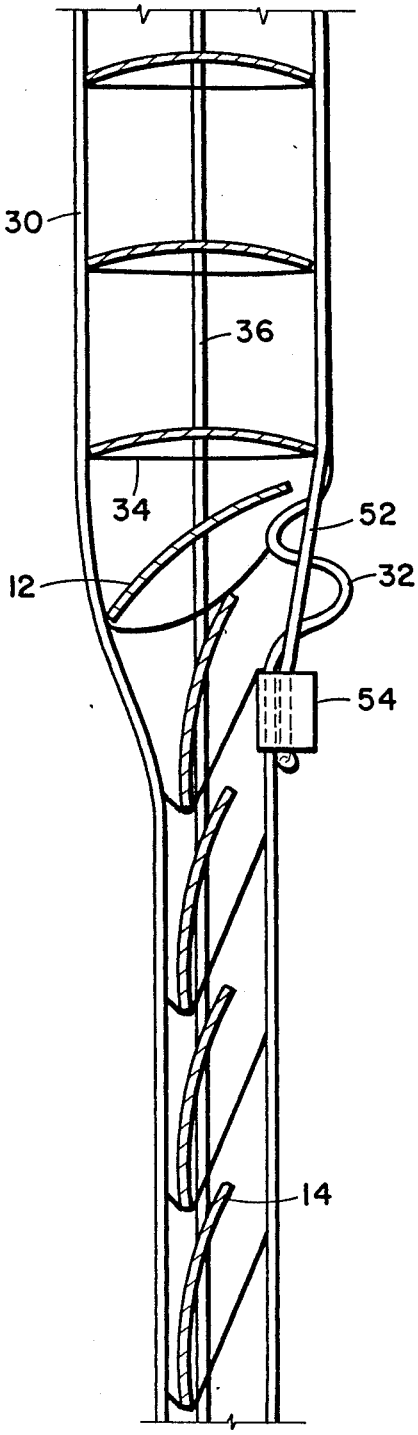
FIG. 5 is a view taken along the line 5—5 of FIG. 3.
Figure 6:
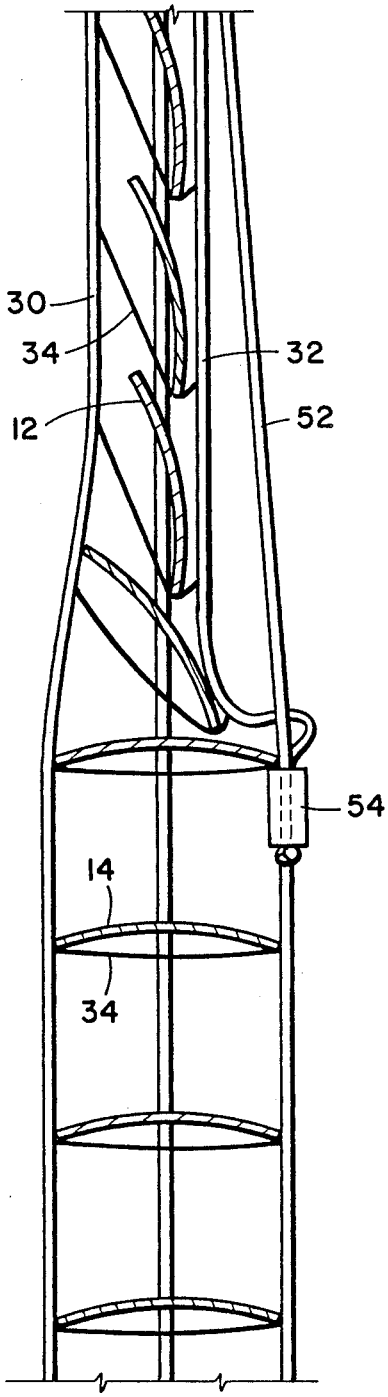
FIG. 6 is similar to FIG. 5 except that the top portion of the venetian blind is closed and the bottom part is open.

Attention is next directed to FIGS. 3 and 4 which shows my improvement upon a commercially available window blind especially of the miniblind variety. FIG. 3 shows the back side of the upper right hand corner of FIG. 1 which is a front view. The drawstring 22 includes a drawstring 30 which is associated with ladder string system 16 and extends along the ladder support system from top support 10 to weight bar 18. There is a second vertical drawstring (not shown) which is associated with ladder support system 14. As shown in FIGS. 5 and 6, the ladder support system includes a front ladder string 30, a back ladder string 32 and slat support strings 34. There is a drawstring 36 for each ladder support system 14 and 16 and each drawstring extends from drawstring knob or button 23 upwardly through an encasement opening 38 in encasement 40 for the regulating strings. There is provided a stop roller 42 which slides up and down in encasement 40 in a conventional manner. A first drawstring 36 extends down through hole or opening 57 in encasement 44, down through holes in each slat to the weight bar 18. A second vertical drawstring 37 extends to cooperate with ladder support system 14. The use of drawstring button 22 to pull up or lower the slats from the weight bar 18 by use of vertical drawstrings 36 and 37 is well known. It is also well known to use stem 20 and its associated mechanism for adjusting the inclination or slope of the individual slats 12 which is done, of course, as a unit. That is, all of the slats are adjusted by rotating stem 20. A part of main shaft 41 which is used to adjust the tilt of the slats is also shown.

Figure 2:
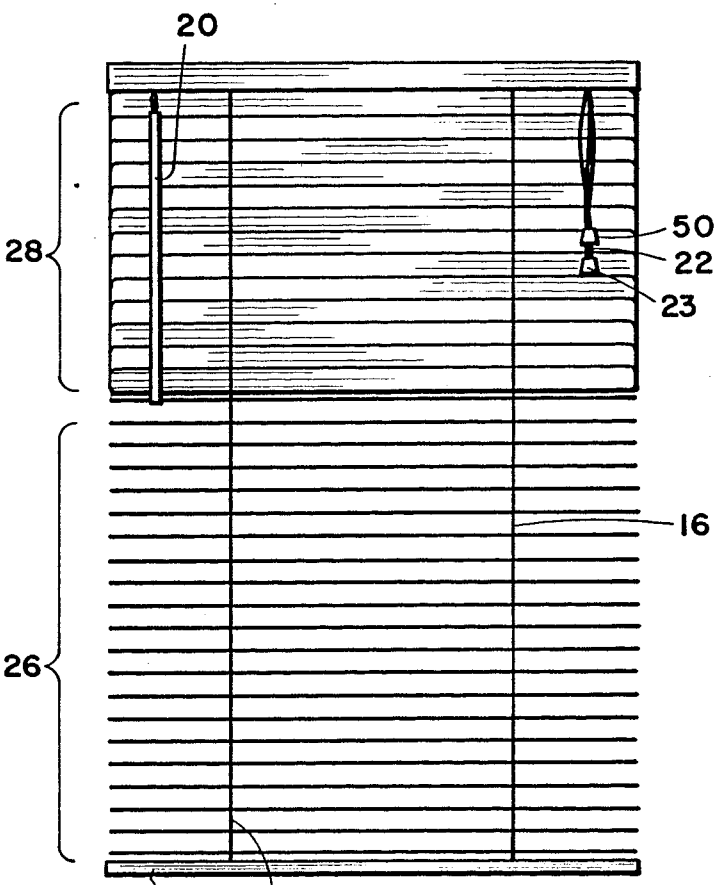
FIG. 2 is similar to FIG. 1 except that the top portion of the blind has been closed for privacy and the lower portion is opened for ventilation and light.

As heretofore said, sometimes it is desirable to have the lower part of a window blocked off from outside view and have the top part open for ventilation or light. This would be the position shown in FIG. 1. In other cases, depending upon where the sun is and what is desired, it might be desired to have the Venetian blinds as shown in FIG. 2 with the upper part blocked off to cut out the sun's rays when at a certain elevation and to let the lower part be open for ventilation. This is now possible with the use of my invention. I add a privacy drawstring attached to button 50. I select the point at which I wish to have the division between upper section 28 and lower section 26. I then attach the lower end of privacy drawstring 52 to back ladder string 32 by use of clamp 54. Clamp 54 is securely attached to the lower end of privacy drawstring 32 and is preferably one which can be releasably positioned at any point along back ladder string 32 so that the number of slats in upper section 28 and those in lower section 26 may be varied. Privacy drawstring 52 extends between tassel 50 and clamp 52 and extends through opening 38 in the encasement 40 alongside regular drawstring 36 so that it may be held in position by rounded members 43 and stop roller 42 which, of course, slides up and down as needed. The privacy string extends above member 43, across a part of the top member before it enters opening 56 which is the same opening in encasement 44 through which back ladder string 32 extends, as shown in FIG. 4. As shown in FIG. 3 the privacy drawstring 52 follows closely along back ladder string 32 to clamp 54 where the clamp is attached to back ladder string 32. A second privacy drawstring 53 extends to ladder support system 14 and is attached to its back ladder string similarly as shown in FIG. 3 for back ladder string 32 of ladder support system 16. I now show a modified miniblind with my improvement added thereon. A privacy drawstring unit extends from button 50 to claim 54 and is fed up over catch assembly including items 43 and 38 alongside the regular vertical drawstring 36 and is fed downwardly through opening 56 in encasement 44 alongside the back ladder string 32 until it ends with adjustable clamp 54 where is attached to the back ladder string 32. A second privacy drawstring 53 is also provided. It is to be understood that although I have shown only two ladder support systems that in some cases there may be more. My privacy attachment unit can be provided for each such ladder support system. It is also to be understood that various commercially available units have different openings 56 in encasement 44. Ordinarily no adjustment or modification of the blinds will have to be made except by the addition of the string and the clip attachment. However, if necessary, additional holes or enlargement of holes to accommodate my privacy drawstrings can be made. I have shown the privacy drawstring 52 attached to back ladder string 32. This is to "hide" clamp 54. However, I can extend the privacy drawstring 52 through opening 31 in encasement 44 along front ladder string 30.

The privacy strings 52 and 53 which I add should be of the same size and material as the drawstring so that the operation of the mechanism including the stop roller will operate as well as before I add my privacy strings thereto.

Attention is directed to FIG. 5. In this position the lower slats 11 in sections 26 are all closed and the upper slats 12 in section 28 are all open. I can obtain this position very simply with my invention. I adjust the Venetian blinds, both sections 26 and 28 to be in full open position, I then merely pull down on privacy drawstring button 50. This pulls up on privacy drawstring 52. This lifts the right hand or back ladder sring 32 below the clamp 54 and thus causes the change in the inclination or slope or slats 14 so that the lower slats 14 in lower section 26 are all in the closed position. Inasmuch as the privacy drawstring 52 is attached below the upper section 28, the pulling on the privacy drawstring 52 will have no effect upon the upper section 28 so that the slats there will remain in an open position. It is to be noted that there is a slack in back ladder string 32 just above the clamp 54.

If I wish to reverse the privacy and open part of the Venetian blinds to obtain that shown in FIG. 2 in which the upper part 28 is closed and the bottom part is 26 I can accomplish this very easily. To obtain this, I can twist rotate stem 20 in a direction which would close the Venetian blinds were it not for my improvement thereon. This rotation will close the upper part 28 by lifting front ladder string 30 lifts upon all of the cross members 34 and by doing so it will convert the upper section 28 to a closed position. However, inasmuch as the lower portion 26 is in a closed position it will lift up until they are in an open position as shown in FIG. 6.

When one wishes to return the improved or modified Venetian blinds of my invention back to the normal operation mode, one merely releases the privacy string in the same general type motion that one would use to release the regular drawstrings.

There are various ways in which I can operate my new Venetian blind system. If I wish to point the blinds to reflect the sun outwardly, that is to have the blinds closed but reverse of what they are in the lower portion of FIG. 5 and have the top open I can accomplish that. I first rotate stem 20 until the blind is completely closed and all the slats 12 and 14 are tilted as the slats 12 in the upper part of FIG. 6. I then pull on privacy drawstring button 50 to pull upon the privacy drawstrings 52 and 53. This will open the bottom portion 26 and will leave the top part 28 closed. I can change from this position in various ways. I can rotate the roller cam by rotating stem 20 which will open the top portion 28 and close the bottom portion 26. If I wish to I can continue rotation of stem 20 and close the entire window blind.

Figure 11:
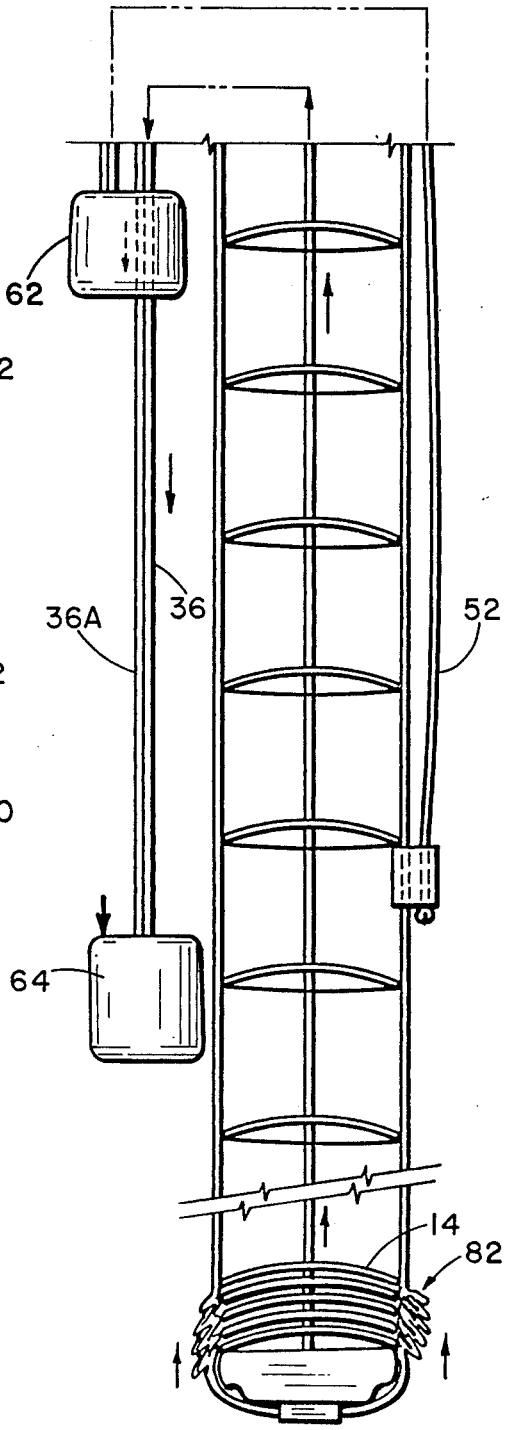
FIG. 11 is similar to FIG. 8 except that the main drawstring has been pulled independently of the privacy drawstring and has the slats of the lower section into a well stacked bundle.
Figure 12:
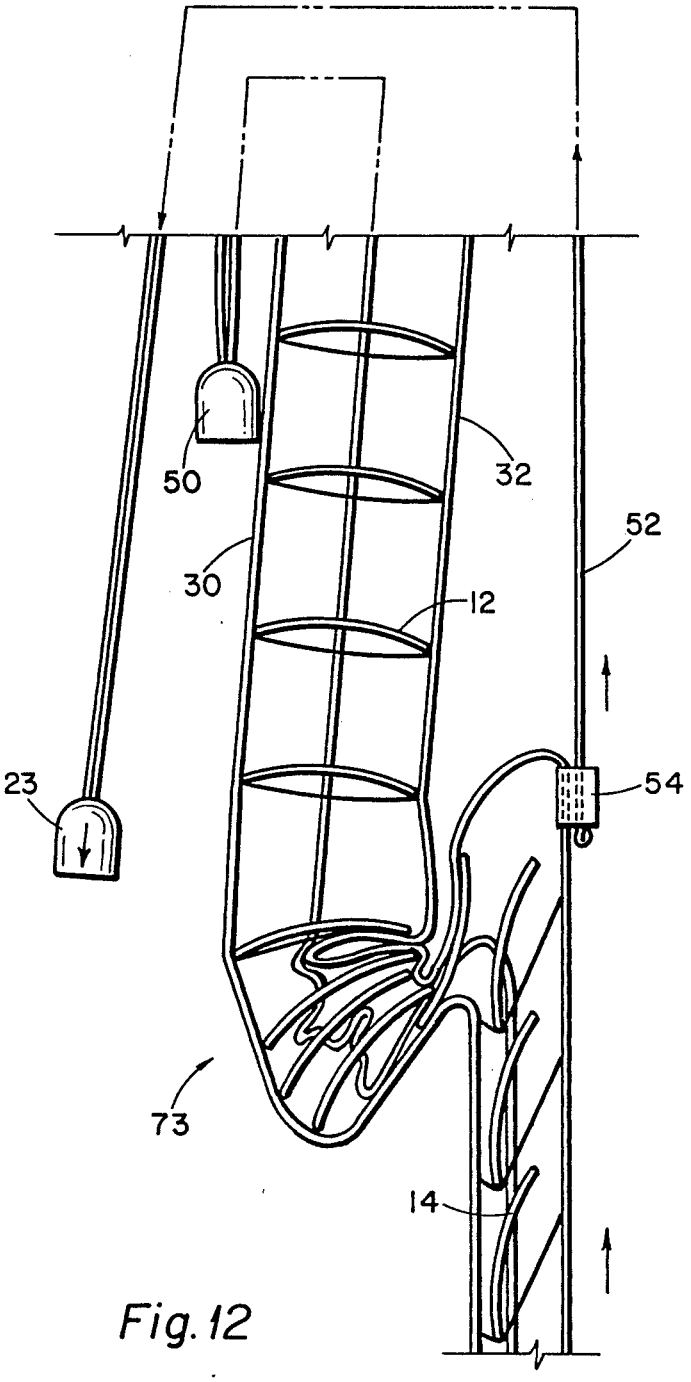
FIG. 12 illustrates the results of overpull on the privacy drawstrings showing unaligned rollover which may occur in some instances if my preferred embodiment is not used.

Attention is next directed to FIG. 12 which shows the problem if one overpulls on an independent privacy drawstring. If one does not pull on the privacy drawstring for a distance greater than the distance between two adjacent slats no problem occurs. The distance varies in commercially available blinds generally at ½", ¾", 1 " or 2". Therefore, the margin of proper operation is very limited. The Venetian blind with the privacy drawstring will work. However, if one should overpull the independent privacy drawstring then there will be some rollover of some slats such as shown in FIG. 12 at 73. It is seen that these slats at 73 are not vertically aligned with the rest of the slats in the Venetian blind. This does present problems. From an aesthetic sense the blind is rendered commercially unattractive by this rollover. When the blind is sandwiched between panes of glass the blind will jam and may render the blind inoperable from its normal opening and lifting operations. Bunching of the slats in a non-enclosed environment may cause slats to tangle which may scar the paint finish or bend slats and therefore cause self-damage. In this regard attention is next directed to FIGS. 7, 8, 9, 10 and 11.

Figure 7:
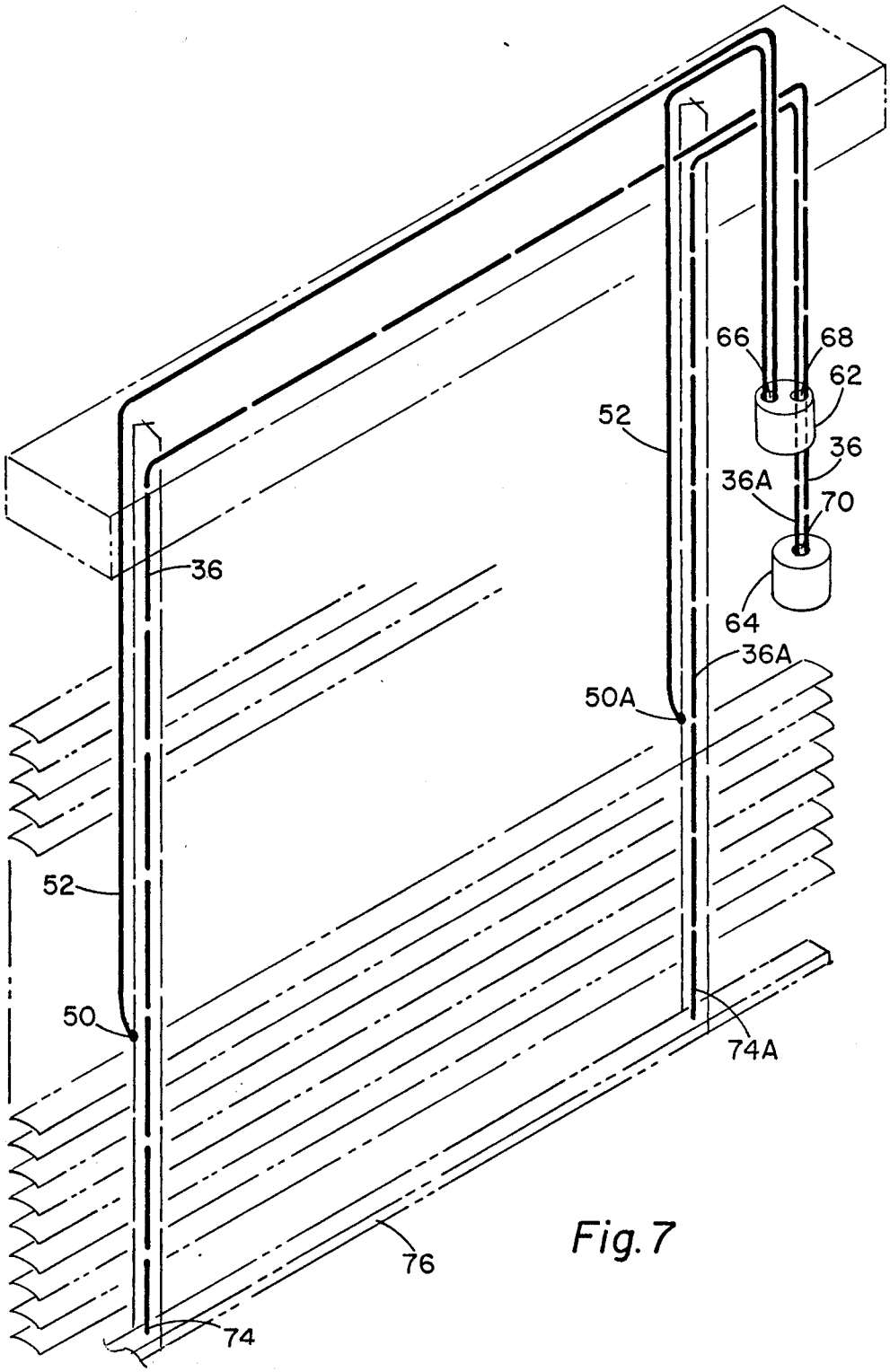
FIG. 7 illustrates a preferred embodiment of my invention installed on a Venetian blind.
Figure 8:
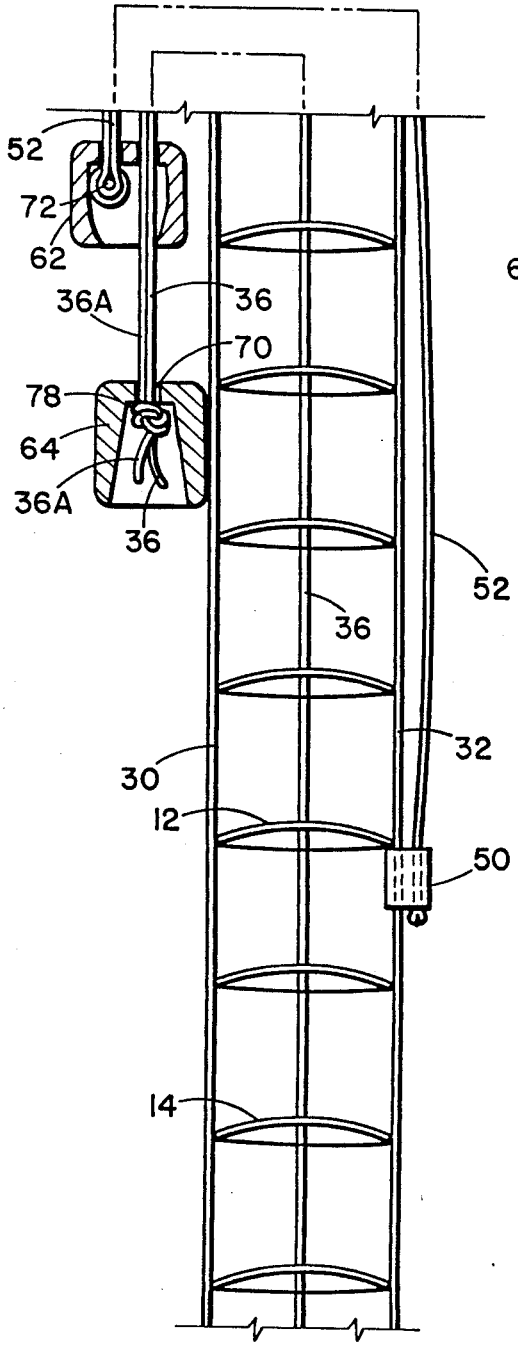
FIG. 8 is an end view of a portion of a Venetian blind in an open position with my preferred embodiment installed.
Figure 9:
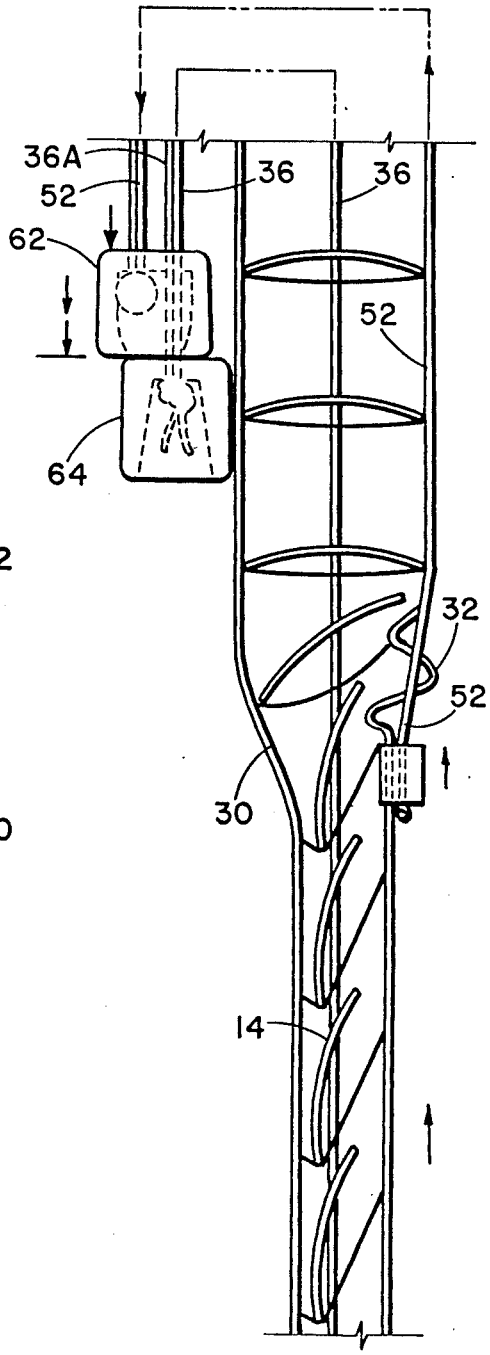
FIG. 9 is similar to FIG. 8 except that the lower part of the Venetian blind has been closed independent of the upper section.
Figure 10:
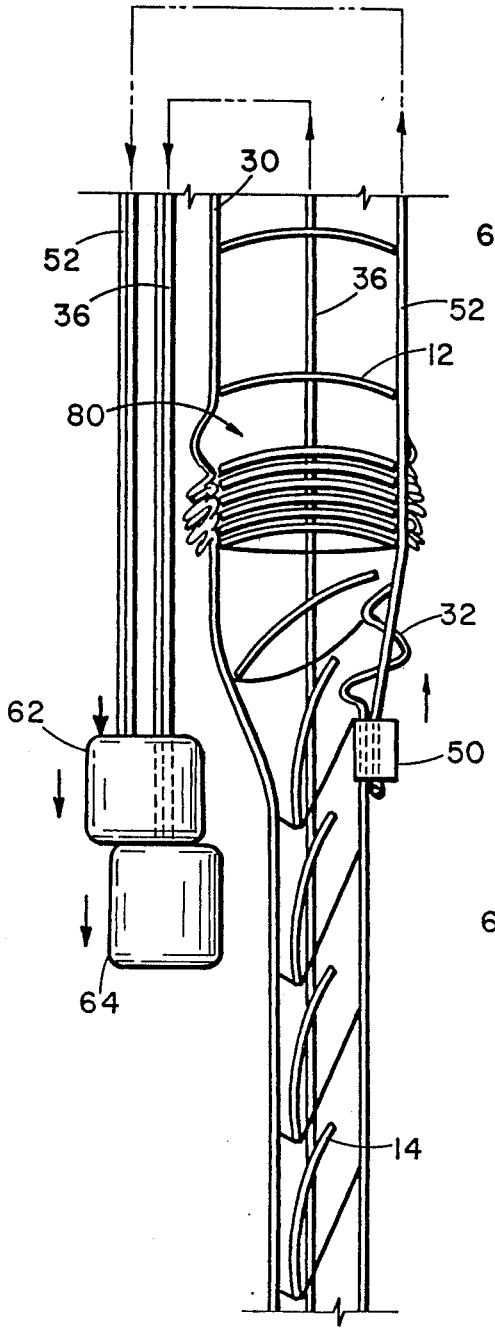
FIG. 10 is similar to FIG. 9 except that the privacy drawstring and main drawstring pull are in contact and have been pulled stacking a portion of the slats in the upper open section.

As shown in FIG. 7 I have an uppe cylindrical pull 62 with holes 66 and 68 therein and a second or lower pull 64 which has hole 70 therein. As shown more clearly in FIG. 8 privacy pull string 52 may be in one piece and secured around pin 72 within upper pull 62. The one end of the privacy drawstring 52 is attached at 50 to the left end of the Venetian blind shown in FIG. 7 and the other end is attached to 50A at the right hand ladder. The main drawstring is really shown in two parts, parts 36 and 36A. One end of of main drawstring 36 is attached at 74 to weight bar 76. One end of main drawstring 36A is connected at 74A to the other end of weight bar 76. As seen in FIG. 8 as well as FIG. 7 main drawstring sections 36A and 36 extend freely through hole 68 in upper pull 62. The ends of the main pull string sections 36 and 36A are tied together at the lower end to form a knot 78 within the cavity of lower pull 64. The strings 36 and 36A are adjusted before being tied so that they are each of the proper length to give a smooth pull by the main drawstring. FIG. 8 shows the miniblind in an open position and with the upper pull 62 slightly above the lower pull 64 which is a distance approximately equal to the distance between the slats 12. When it is desired to close off the lower section of slats, the upper pull 62 is pulled downwardly as indicated in FIG. 9 until it contacts the lower pull 64. At this time the lower slats 14 are in a closed position. Further pull on the privacy upper pull 62 will result in an operation as illustrated in FIG. 10. The slats 12 are in a neat stack 80 and there is no rollover even though the privacy pull 62 has been pulled several times the length of the distance between adjacent slats. During this operation the main drawstring remains taut. FIG. 11 illustrates how the main drawstring can be operated independently of the privacy drawstring. There, lower or main drawstring pull 64 has pulled the drawstrings 36 and 36A downwardly to pull the lower slats 14 into a neat stack 82. It is noted that the Venetian blind in FIG. 11 is opened similarly to that of FIG. 8, but that the main drawstring has been pulled a considerable distance. This system lets the main drawstring act independently but when used in conjunction with the privacy pull one can utilize the privacy drawstring along with the main drawstring to get the desired effect of slats aligning themselves one on top of the other. This is especially useful for miniblinds which are enclosed in glass or face curtains or other window treatments.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A window blind comprising:

a top member;

a plurality of horizontal slats;

at least two ladder support systems supporting said slats and in which each system has a front ladder string exterior of said slats, a back ladder string and a plurality of slat support strings connecting the two ladder strings at spaced positions therealong;

a mechanism supported by said top member and operable by rotating the stem for adjusting the front ladder string with respect to the back ladder string so as to adjust the inclination of each slat;

each said slat having a hole therein adjacent said each said slat support string;

a drawstring support and locking mechanism supported by the top member;

a main drawstring and pull knob for lifting the slats and extending through the holes thereof;

a guide in the top member and having a passage means therethrough for the main drawstring and for each said front ladder string and for each said back ladder string;

the path of said main drawstring extending from adjacent one end of said slats upwardly through said drawstring support and locking mechanism, along said top member, down said passage means, through the holes in said slats and secured at the lower end of said window blind;

at least one privacy drawstring having a first end and a second end, the path of said privacy drawstring beginning at or near the first end of said main drawstring following upwardly along said main drawstring through said support and locking mechanism, then along said top member adjacent said main drawstring, thence down the opening means in said top along side and adjacent one of said ladder strings down to a selected located on such ladder string, the privacy drawstring passing over no pulley or support not passed over by said main drawstring;

means to attach the second end of said privacy drawstring to a ladder string at said selected location;

a privacy pull knob means slidably interconnected to said main drawstring, and said privacy pull knob means connected to said first end of said privacy drawstring.

2. A window blind as defined in claim 1 in which said means to attach is a clamp means which can be releasably clamped to said ladder string.

3. An improvement to a Venetian blind for hanging in a window which has a plurality of slats supported on at least one ladder support system in which each said ladder support system has a front ladder support system in which each said ladder support system has a front ladder string, a back ladder string and a plurality of slat support strings connecting the back ladder string and the front ladder string, a plurality of slats, there being a slat on each such slat support string, a weight bar, means to adjust the tilt or inclination of the slats, the improvement which comprises:

a privacy pull having a first hole extending therethrough;

a main drawstring pull;

a main drawstring fixed to said main drawstring pull and extending through said first hole in said privacy drawstring pull through a stop roller means, along a top support to an opening and downwardly to a weight bar;

a privacy drawstring secured to said privacy drawstring pull and extending upwardly through the stop roller that said main drawstring extends and along said top support adjacent said main drawstring, then down through said top support along one of the ladder strings where it is secured to one of said ladder strings at a selected location.

4. An improvement as defined in claim 3 in which there is a privacy drawstring section for another of said ladder strings such that by pulling on the privacy drawstring pull both privacy drawstring and main drawstring operate through the stop roller locking together such that both drawstrings lock and unlock together when desired.

* * * * *